US009857716B2

(12) United States Patent
Natori et al.

(10) Patent No.: US 9,857,716 B2
(45) Date of Patent: Jan. 2, 2018

(54) CURABLE LIQUID DEVELOPER AND IMAGE-FORMING METHOD USING CURABLE LIQUID DEVELOPER

(71) Applicant: CANON KABUSHIKI KAISHA, Tokyo (JP)

(72) Inventors: Ryo Natori, Tokyo (JP); Waka Hasegawa, Tokyo (JP); Ayano Mashida, Kawasaki (JP); Junji Ito, Hiratsuka (JP); Yasuhiro Aichi, Tokyo (JP); Jun Shirakawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/166,685

(22) Filed: May 27, 2016

(65) Prior Publication Data

US 2016/0349655 A1 Dec. 1, 2016

(30) Foreign Application Priority Data

May 27, 2015 (JP) ..... 2015-107350
Mar. 7, 2016 (JP) ..... 2016-043102

(51) Int. Cl.

| | |
|---|---|
| ***G03G 9/125*** | (2006.01) |
| ***G03G 9/13*** | (2006.01) |
| ***G03G 9/135*** | (2006.01) |
| ***G03G 9/08*** | (2006.01) |
| ***G03G 15/10*** | (2006.01) |

(52) U.S. Cl.
CPC ..... *G03G 9/131* (2013.01); *G03G 9/0819* (2013.01); *G03G 9/125* (2013.01); *G03G 9/13* (2013.01); *G03G 9/135* (2013.01); *G03G 9/1355* (2013.01); *G03G 15/10* (2013.01)

(58) Field of Classification Search
CPC ..... G03G 9/125
See application file for complete search history.

(56) References Cited

U.S. PATENT DOCUMENTS

| | | | | |
|---|---|---|---|---|
| 5,364,726 | A | 11/1994 | Morrison et al. | |
| 5,395,724 | A * | 3/1995 | Morrison | G03G 9/12 430/114 |
| 6,203,961 | B1 | 3/2001 | Pan et al. | |
| 7,833,687 | B2 | 11/2010 | Kato et al. | |
| 8,697,327 | B2 | 4/2014 | Shibata et al. | |
| 8,722,302 | B2 | 5/2014 | Maeda et al. | |
| 8,815,484 | B2 | 8/2014 | Tanaka et al. | |
| 9,057,970 | B2 | 6/2015 | Ida et al. | |
| 9,229,345 | B2 | 1/2016 | Ikeda et al. | |
| 9,348,247 | B2 | 5/2016 | Ida et al. | |
| 2004/0021753 | A1 | 2/2004 | Yoshihiro et al. | |
| 2007/0031751 | A1 | 2/2007 | Teishev et al. | |
| 2008/0032225 | A1 * | 2/2008 | Teshima | G03G 9/12 430/114 |
| 2010/0055602 | A1 | 3/2010 | Teshima | |
| 2011/0183254 | A1 * | 7/2011 | Shoshi | G03G 15/10 430/112 |
| 2014/0234769 | A1 | 8/2014 | Yoshie et al. | |
| 2014/0234770 | A1 * | 8/2014 | Hotta | G03G 9/12 430/112 |
| 2014/0356779 | A1 | 12/2014 | Hasegawa et al. | |
| 2014/0377697 | A1 | 12/2014 | Nishiura et al. | |
| 2015/0004539 | A1 | 1/2015 | Watanabe et al. | |
| 2015/0192875 | A1 * | 7/2015 | Ito | G03G 9/12 430/115 |
| 2015/0274853 | A1 | 10/2015 | Nishiura et al. | |
| 2015/0277254 | A1 | 10/2015 | Mukumoto et al. | |
| 2015/0277257 | A1 * | 10/2015 | Uno | G03G 9/13 430/114 |
| 2016/0349651 | A1 * | 12/2016 | Ito | G03G 9/131 |
| 2016/0349652 | A1 * | 12/2016 | Natori | G03G 9/131 |
| 2016/0349653 | A1 * | 12/2016 | Tanabe | G03G 9/131 |

FOREIGN PATENT DOCUMENTS

| | | | |
|---|---|---|---|
| EP | 0 586 051 | | 3/1994 |
| EP | 1 898 267 | | 3/2008 |
| EP | 2 955 579 | | 12/2015 |
| JP | 2002012607 | A | 1/2002 |
| JP | 2002188025 | A | 7/2002 |
| JP | 2003026978 | A | 1/2003 |
| JP | 3442406 | B2 | 9/2003 |
| JP | 2003342503 | A | 12/2003 |
| JP | 2010060849 | A | 3/2010 |
| JP | 5148621 | B2 | 2/2013 |
| JP | 5277800 | B2 | 8/2013 |
| JP | 2013152348 | * | 8/2013 ..... G03G 9/13 |

OTHER PUBLICATIONS

Machine English langauge translation of JP 2013152348, Aug. 8, 2013.*

S. Ito, "Dictionary of Pigments", pp. 258-263, pp. 282-285, pp. 290-291, pp. 294-295, pp. 306-307, pp. 314-315, pp. 320-321, pp. 326-335, pp. 338-349, Main text and Figs. II.4.73-II.4.75.

Y. Harasaki, "Coating Basics and Engineering", Converting Technical Institute, p. 53, Table 3.9.

S. Ito, "Dictionary of Pigments", pp. 345-349, Main text and Figs. II.3.73-II.4.75.

W. Herbst, et al., "Industrial Organic Pigments", List of Commercially Available Pigments, pp. 637-645.

* cited by examiner

*Primary Examiner* — Hoa V Le
(74) *Attorney, Agent, or Firm* — Fitzpatrick Cella Harper and Scinto

(57) ABSTRACT

A curable liquid developer containing a curable insulating liquid and a toner particle that contains a pigment and a resin, wherein the viscosity of the curable insulating liquid at 25° C. is at least 1 mPa·s and not more than 100 mPa·s, and when A (mPa·s) is the viscosity of the curable liquid developer at 25° C. in a case where the toner particle concentration in the curable liquid developer is 50 mass %, and B (mPa·s) is the viscosity of the curable liquid developer at 25° C. in a case where the toner particle concentration in the curable liquid developer is 1 mass %, the value of A−B is not more than 1,000 mPa·s.

8 Claims, 2 Drawing Sheets

CURABLE LIQUID DEVELOPER AND IMAGE-FORMING METHOD USING CURABLE LIQUID DEVELOPER

BACKGROUND OF THE INVENTION

Field of the Invention

The present invention relates to a curable liquid developer for use in image-forming apparatuses that utilize an electrophotographic system, such as electrophotography, electrostatic recording, and electrostatic printing. The present invention also relates to an image-forming method that uses this curable liquid developer.

Description of the Related Art

The needs imposed by color output on image-forming apparatuses that use an electrophotographic system, e.g., copiers, facsimile machines, printers, and so forth, have been increasing in recent years. Within this context, development is becoming quite active with regard to high-image-quality, high-speed digital printing apparatuses that utilize an electrophotographic technology that uses liquid developers, which provide an excellent fine line image reproducibility, an excellent gradation reproducibility, an excellent color reproducibility, and excellent image formation at high speeds. In view of these circumstances, there is demand for the development of liquid developers that have even better properties.

A dispersion of colored resin particles in an insulating liquid, e.g., a hydrocarbon organic solvent or silicone oil, is already known as a liquid developer. However, when the insulating liquid of such a liquid developer remains present on the recording medium, e.g., paper or plastic film, this ends up causing a substantial decline in the appearance of the image, and due to this the insulating liquid must be removed. In a method generally used to remove the insulating liquid, thermal energy is applied to volatilize and remove the insulating liquid. However, this has not necessarily been preferred from an environmental perspective, e.g., the vapor of a volatile organic solvent is emitted from the apparatus during removal by volatilization, a large amount of energy is consumed during removal by volatilization, and so forth.

As a countermeasure to this, Japanese Patent No. 3,442,406 discloses a method in which a reactive functional group-bearing insulating liquid is cured.

A reactive functional group-bearing monomer or oligomer is used as a curable insulating liquid in Japanese Patent No. 3,442,406. This liquid developer is capable of an image formation that consumes less energy than a heat-fixing system, which requires the application of thermal energy to volatilize and remove the insulating liquid. In addition, a method based on wet pulverization is disclosed as a method for producing this liquid developer.

A liquid developer capable of electrostatic transfer onto a recording medium is disclosed in Japanese Patent No. 5,277,800. This liquid developer is capable of image formation at low energy consumptions because it does not require that the intermediate transfer member be heated.

SUMMARY OF THE INVENTION

When electrostatic transfer to a recording medium is attempted with the liquid developer taught in Japanese Patent No. 3,442,406 in pursuit of additional energy savings, a problem has been that the transfer efficiency undergoes a substantial worsening to the point that image formation itself can be problematic.

When, on the other hand, the attempt is made with the liquid developer taught in Japanese Patent No. 5,277,800 to form, on a recording medium, an image in particular having a high toner particle concentration, the desired toner particle migration and liquid separation have not occurred during transfer onto the recording medium, and in some cases the formation of a uniform high-density image has not been satisfactory.

The present invention was pursued in view of these circumstances. That is, the present invention provides a liquid developer that is capable of forming a thin-film, high-density image in image-forming systems in which a liquid developer is electrostatically transferred onto a recording carrier and is cured on the recording carrier. The present invention additionally provides an image-forming method that uses this liquid developer.

The present inventors discovered that, in order to carry out toner particle migration and liquid separation electrostatically during transfer onto a recording medium, where the toner concentration reaches the highest, it was effective to focus on the viscosity change by the liquid developer when the toner particle concentration is raised. The present invention was achieved based on this discovery.

That is, the present invention is a curable liquid developer that contains a curable insulating liquid and a toner particle that contains a pigment and a resin, wherein the viscosity of the curable insulating liquid at 25° C. is at least 1 mPa·s and not more than 100 mPa·s, and when A (mPa·s) is the viscosity of the curable liquid developer at 25° C. in a case where the toner particle concentration in the curable liquid developer is 50 mass %, and B (mPa·s) is the viscosity of the curable liquid developer at 25° C. in a case where the toner particle concentration in the curable liquid developer is 1 mass %, the value of A−B is not more than 1,000 mPa·s.

The present invention is also an image-forming method that includes: forming an electrostatic latent image on a surface of an image bearing member; developing, with a curable liquid developer, the electrostatic latent image, which has been formed on the surface of the image bearing member, and forming an image; transferring onto a recording medium the image, which has been formed on the surface of the image bearing member; and fixing the image to the recording medium after curing the image, which has been transferred to the recording medium, wherein the curable liquid developer is the curable liquid developer of the present invention and the toner particle concentration in the image, which has been transferred to the recording medium, is at least 40 mass % and not more than 80 mass %.

The present invention can provide a liquid developer and an image-forming method that are capable of forming a thin-film, high-density image in image-forming systems in which a curable liquid developer is cured on a recording carrier.

Further features of the present invention will become apparent from the following description of exemplary embodiments (with reference to the attached drawings).

DESCRIPTION OF THE EMBODIMENTS

Figure 1:
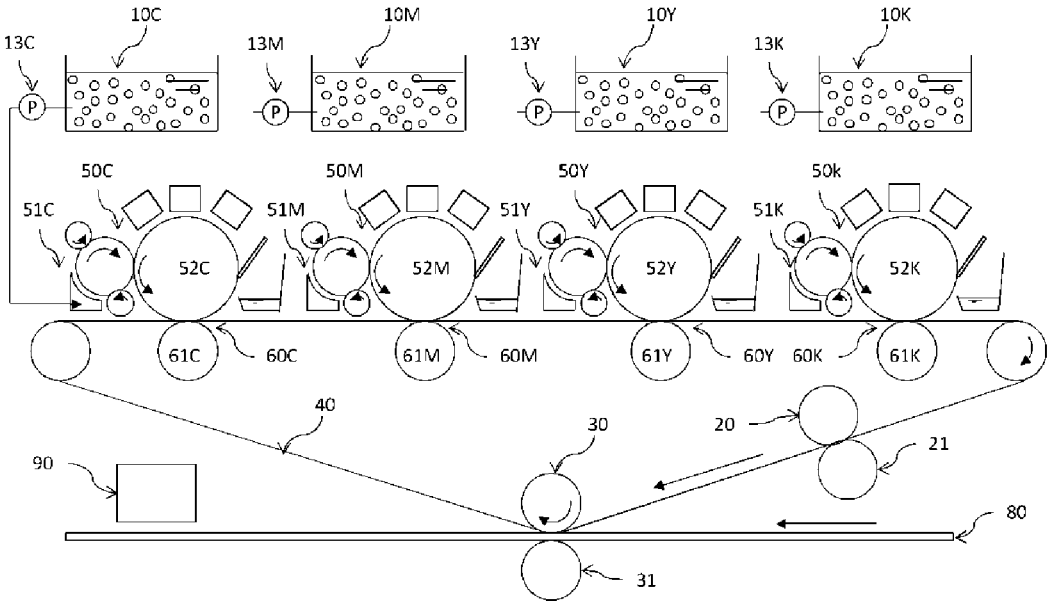
FIG. 1 is a schematic structural diagram of the main part of an image-forming apparatus.

The curable liquid developer of the present invention (also referred to herebelow simply as the liquid developer of the present invention) is a curable liquid developer that contains a curable insulating liquid and a toner particle that contains a pigment and a resin, wherein the viscosity of the curable insulating liquid at 25° C. is at least 1 mPa·s and not more than 100 mPa·s and the value of A−B is not more than 1,000 mPa·s where A (mPa·s) is the viscosity of the curable liquid developer at 25° C. when the toner particle concentration in the curable liquid developer is 50 mass % and B (mPa·s) is the viscosity of the curable liquid developer at 25° C. when the toner particle concentration in the curable liquid developer is 1 mass %.

The toner particle concentration in the liquid developer undergoes an increase in concentration when a step of electrostatic toner particle transfer is present in the electrophotographic process that uses the liquid developer.

A characteristic feature of the curable liquid developer of the present invention is that the change in viscosity accompanying the change in toner particle concentration in the steps taken by the image-forming system is in a certain prescribed range.

As a general matter, Einstein's viscosity equation is known to be an equation that gives the relationship between a particle and the slurry viscosity. However, Einstein's viscosity equation is applicable only when the application range is at low concentrations and for completely spherical particles, and the current circumstance is that the relationship for slurry viscosity has still not been adequately elucidated for highly concentrated slurries and for particles for which the circularity is not perfect.

As a result of various investigations into curable liquid developers, the present inventors focused on the viscosity change accompanying the changes in the toner particle concentration in the liquid developer and discovered that the problems indicated above could be solved when this viscosity change was in a certain prescribed range.

Defining A (mPa·s) as the viscosity of the curable liquid developer at 25° C. when the toner particle concentration in the curable liquid developer is 50 mass % and B (mPa·s) as the viscosity of the curable liquid developer at 25° C. when the toner particle concentration in the curable liquid developer is 1 mass %, the value yielded by subtracting this B from this A, i.e., the value of A−B, is not more than 1,000 mPa·s in the present invention.

In an image-forming system in which the curable insulating liquid remains on the recording medium after the image has been fixed, it is necessary to make the image on the recording medium post-transfer into a highly concentrated thin film.

The interactions between toner particles can be made small by keeping the viscosity change of the curable liquid developer—in the prescribed toner particle concentration range—to the values of the present invention.

As a result, in the case in particular of a high toner particle concentration, a uniform and high-density arrangement of the toner particles in the curable insulating liquid can be induced in the transfer step by the electric field.

In addition, a thinning of the curable insulating liquid-containing toner particle film is similarly enabled in the transfer step in the phenomenon of liquid separation of the curable insulating liquid from the curable insulating liquid-containing particle film at the nip outlet.

When the value of A−B exceeds 1,000 mPa·s, this impedes the electric field-induced uniform and high-density arrangement of the toner particles in the curable insulating liquid in the transfer step. Liquid separation of the curable insulating liquid from the curable insulating liquid-containing toner particle film at the nip outlet in the transfer step is similarly impeded.

The value of A−B is preferably at least 0.1 mPa·s and not more than 800 mPa·s, more preferably at least 0.1 mPa·s and not more than 600 mPa·s, even more preferably at least 0.1 mPa·s and not more than 300 mPa·s, and particularly preferably at least 0.1 mPa·s and not more than 100 mPa·s.

The value of A−B can be controlled into the aforementioned range by, for example, adjusting the average circularity of the toner particle and/or the volume-average particle diameter of the toner particle.

The materials used by the present invention are described in detail in the following.

[The Curable Insulating Liquid]

The curable insulating liquid in the present invention is not particularly limited as long as it has a high volume resistivity, is electrically insulating, and has a viscosity at 25° C. of at least 1 mPa·s and not more than 100 mPa·s.

When the viscosity of the curable insulating liquid at 25° C. is higher than 100 mPa·s, the toner particle electrophoretic mobility declines, which leads to a decline in the printing speed.

The viscosity of the curable insulating liquid at 25° C. is preferably at least 1 mPa·s and not more than 50 mPa·s and is more preferably at least 1 mPa·s and not more than 30 mPa·s.

In addition, the volume resistivity of the curable insulating liquid is preferably at least $1\times10^{8}$ Ω·cm and not more than $1\times10^{13}$ Ω·cm and more preferably at least $1\times10^{9}$ Ω·cm and not more than $1\times10^{12}$ Ω·cm.

A volume resistivity lower than $1\times10^{8}$ Ω·cm facilitates a drop in the potential of the electrostatic latent image and sets up a trend of impeding the generation of a high optical density and facilitating the occurrence of image blurring.

The curable insulating liquid of the present invention is also preferably selected from liquids that do not dissolve the resin present in the toner particle.

Specifically, it is preferably selected from curable insulating liquid/resin combinations for which not more than 1 mass parts of the resin dissolves in 100 mass parts of the curable insulating liquid.

When the solubility of the resin exceeds this, a trend is set up wherein toner particle formation is impaired.

The curable insulating liquid of the present invention preferably contains a polymerizable liquid monomer.

This polymerizable liquid monomer preferably is a component capable of undergoing polymerization through a photopolymerization reaction. The photopolymerization reaction may be a reaction induced by any type of light, but is more preferably a reaction induced by ultraviolet radiation. That is, the curable insulating liquid is preferably an ultraviolet-curable insulating liquid.

This polymerizable liquid monomer can be exemplified by vinyl ether compounds, acrylic compounds, and cyclic ether compounds such as epoxy compounds and oxetane compounds.

Among these, cationically polymerizable liquid monomers and specifically vinyl ether compounds, epoxy compounds, and oxetane compounds are preferred in the present invention.

The curable insulating liquid in the present invention may contain a single polymerizable liquid monomer by itself or may contain a combination of two or more.

The curable insulating liquid more preferably contains a cationically polymerizable vinyl ether compound. Vinyl ether compounds exhibit little intramolecular polarization of the electron density, and as a consequence a curable liquid developer that exhibits a high resistance, a low viscosity, and a high sensitivity can be obtained by using a vinyl ether compound.

Here, a vinyl ether compound refers to a compound that has a vinyl ether structure (—CH═CH—O—C—).

This vinyl ether structure is preferably given by R—CH═CH—O—C— (R is hydrogen or $C_{1-3}$ alkyl and is preferably hydrogen or methyl).

In a preferred embodiment, the cationically polymerizable liquid monomer in the present invention is also a vinyl ether compound that does not contain a heteroatom outside the vinyl ether structure.

Here, "heteroatom" denotes an atom other than the carbon atom and hydrogen atom.

When a heteroatom is present in the vinyl ether compound, this facilitates the appearance of an intramolecular polarization of the electron density due to the difference between the electronegativity of the heteroatom and that of the carbon atom; also, the empty electron orbitals and/or unshared electron pairs possessed by the heteroatom can readily form pathways for conduction electrons or holes. A decline in the resistance is facilitated as a consequence.

In a preferred embodiment in the present invention, the cationically polymerizable liquid monomer is also a vinyl ether compound that does not contain a carbon-carbon double bond outside of the vinyl ether structure in the vinyl ether compound. The carbon-carbon double bond has a high energy level occupied molecular orbital and a low energy level unoccupied molecular orbital, and these readily form a pathway for electrons and holes and then readily lead to a decline in the resistance. When a carbon-carbon double bond is present in the vinyl ether compound outside of the vinyl ether structure, a reduction in the resistance is facilitated by this mechanism.

The vinyl ether compound is preferably given by the following general formula (C) in the present invention.

$$(H_2C{=}CH{-}O{-})_nR \qquad \text{formula (C)}$$

[In formula (C), n represents the number of vinyl ether structures in one molecule and is an integer that is at least 1 and not more than 4. R is an n-valent hydrocarbon group.]

n is preferably an integer that is at least 1 and not more than 3.

R preferably is a group selected from $C_{1-2C}$ linear-chain or branched, saturated or unsaturated aliphatic hydrocarbon groups, $C_{5-12}$ saturated or unsaturated alicyclic hydrocarbon groups, and $C_{6-14}$ aromatic hydrocarbon groups, and these alicyclic hydrocarbon groups and aromatic hydrocarbon groups may have a $C_{1-4}$ saturated or unsaturated aliphatic hydrocarbon group.

R is more preferably a $C_{4-18}$ linear-chain or branched saturated aliphatic hydrocarbon group.

Specific examples of the vinyl ether compound [example compounds B-1 to B-30] are given below, but the present invention is not limited to or by these examples.

(B-1)

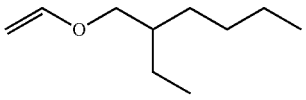

-continued (B-2)

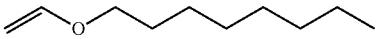

(B-3)

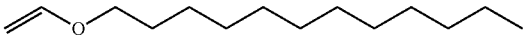

(B-4)

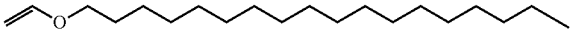

(B-5)

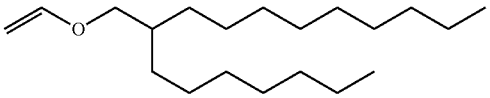

(B-6)

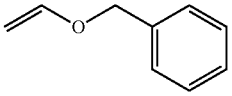

(B-7)

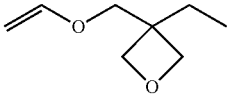

(B-8)

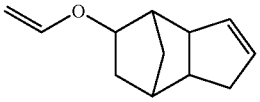

(B-9)

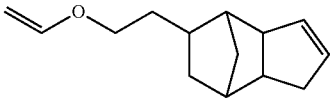

(B-10)

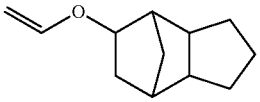

(B-11)

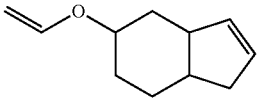

(B-12)

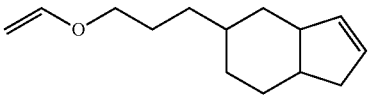

(B-13)

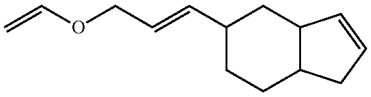

(B-14)

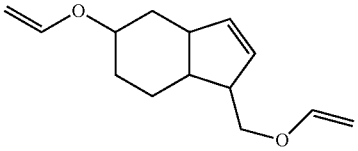

(B-15)

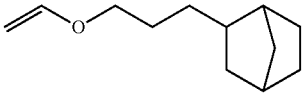

-continued (B-16)

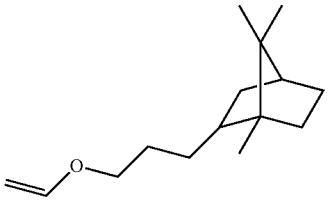

(B-17)

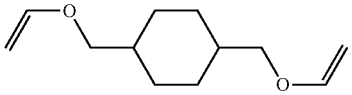

(B-18)

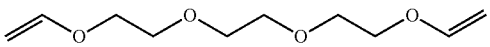

(B-19)

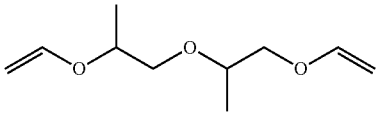

(B-20)

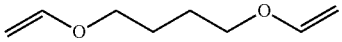

(B-21)

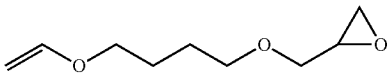

(B-22)

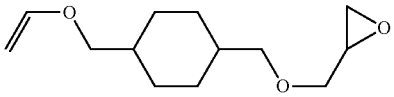

(B-23)

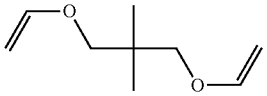

(B-24)

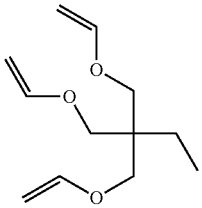

(B-25)

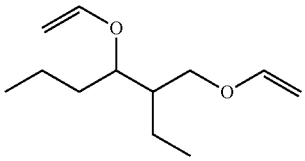

(B-26)

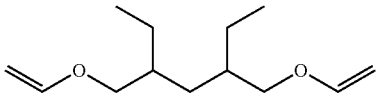

(B-27)

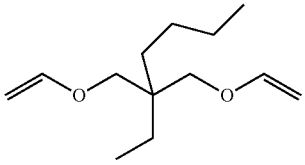

-continued (B-28)

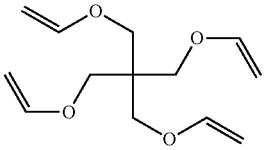

(B-29)

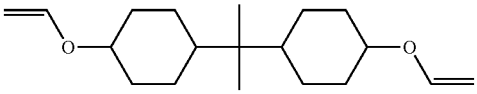

(B-30)

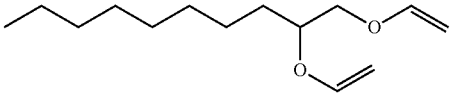

The following, for example, are preferred among the preceding: dodecyl vinyl ether (B-3), dicyclopentadiene vinyl ether (B-8), cyclohexanedimethanol divinyl ether (B-17), tricyclodecane vinyl ether (B-10), dipropylene glycol divinyl ether (B-19), trimethylolpropane trivinyl ether (B-24), 2-ethyl-1,3-hexanediol divinyl ether (B-25), 2,4-diethyl-1,5-pentanediol divinyl ether (B-26), 2-butyl-2-ethyl-1,3-propanediol divinyl ether (B-27), neopentyl glycol divinyl ether (B-23), pentaerythritol tetravinyl ether (B-28), and 1,2-decanediol divinyl ether (B-30).

[The Toner Particle]

The toner particle in the present invention contains a pigment and a resin.

The volume-average particle diameter of the toner particle is preferably at least 0.1 μm and not more than 5.0 μm, more preferably at least 0.1 μm and not more than 2.5 μm, even more preferably at least 0.1 μm and not more than 1.5 μm, and particularly preferably at least 0.1 μm and not more than 1.2 μm.

A satisfactorily high resolution by the toner image formed by the liquid developer can be provided when the volume-average particle diameter of the toner particle is in the indicated range. In addition, a satisfactorily thin film thickness can be provided for the toner image in recording systems in which a curable insulating liquid is cured, and high-definition image formation is made possible.

The average circularity of the toner particle, on the other hand, is preferably at least 0.946, more preferably at least 0.948, even more preferably at least 0.950, and particularly preferably at least 0.970.

When the average circularity of the toner particle is within the indicated range, a satisfactory transferability can be secured in the process of image formation on the recording medium even when electrostatic transfer is required. In addition, a satisfactorily thin film thickness can be provided for the toner image—even at a high toner particle concentration—in recording systems in which a curable insulating liquid is cured, and high-definition image formation is made possible.

The method of producing the toner particle is not particularly limited and can be exemplified by methods such as the coacervation method and the wet pulverization method.

In the coacervation method, a toner particle is produced by mixing a pigment, a resin, a solvent that dissolves the resin, and a solvent that does not dissolve the resin and removing the solvent that dissolves the resin from the mixture.

In the wet pulverization method, a toner particle is produced by kneading a resin with a pigment at or above the melting point of the resin followed by dry pulverization and then wet pulverization of the resulting kneaded material in a liquid medium.

A general toner particle production method can also be used in which a pigment, a resin, and a liquid medium are mixed and a wet pulverization is carried out using, for example, a bead mill.

The coacervation method is described further as an example of a toner particle production method.

A toner particle can be produced by the coacervation method in the present invention by proceeding through (1) a step of mixing a pigment, a resin, a solvent that dissolves the resin, and additives, e.g., a toner particle dispersing agent, to prepare a mixture in which the resin is dissolved, and (2) a step of mixing the obtained mixture with a curable insulating liquid that does not dissolve the resin and, by stirring using, for example, a disperser, precipitating the resin that had been present dissolved in the mixture, whereby the pigment is incorporated.

Here, the volume-average particle diameter and average circularity of the toner particle can be controlled, for example, by changing the type and amount of addition of the toner particle dispersing agent.

The volume-average particle diameter and average circularity of the toner particle can also be controlled, for example, by changing the intensity of the stirring with the disperser in (2).

The volume-average particle diameter and average circularity of the toner particle can also be controlled, for example, by changing the type of resin.

In addition, a toner particle dispersion is obtained by removing the solvent after toner particle precipitation in (2). The curable liquid developer of the present invention, in which toner particles are dispersed in a curable insulating liquid, can be produced by mixing this toner particle dispersion, a curable insulating liquid, and as necessary additives such as a charge control agent.

The toner particle concentration in the curable liquid developer in the present invention is desirably brought to approximately at least 1 mass % and not more than 70 mass % and is preferably brought to approximately at least 1 mass % and not more than 50 mass % and is more preferably brought to approximately at least 2 mass % and not more than 40 mass %.

[Resin]

Known binder resins that have a fixing performance for adherends such as paper and plastic film can be used as the aforementioned resin. A single one of these can be used or two or more can be used in combination.

Specific examples are as follows: homopolymers of styrene and its substituted forms, e.g., polystyrene, poly-p-chlorostyrene, and polyvinyltoluene; styrenic copolymers, e.g., styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloromethacrylate copolymers, styrene-acrylonitrile copolymers, styrene-vinyl methyl ether copolymers, styrene-vinyl ethyl ether copolymers, and styrene-vinyl methyl ketone copolymers; and also polyvinyl chloride, phenolic resins, natural resin-modified phenolic resins, natural resin-modified maleic acid resins, acrylic resins, methacrylic resins, polyvinyl acetate, silicone resins, polyester resins, polyurethane, polyamide resins, furan resins, epoxy resins, xylene resins, polyvinyl butyral, terpene resins, coumarone-indene resins, and petroleum-based resins.

Polyester resins are preferred among the preceding from the standpoint of the granulating properties.

The condensation polymerization product from an alcohol monomer and a carboxylic acid monomer is used as the polyester resin.

The alcohol monomer can be exemplified by the following:

alkylene oxide adducts on bisphenol A, e.g., polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, glycerin, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid monomers, on the other hand, can be exemplified by the following:

aromatic dicarboxylic acids such as phthalic acid, isophthalic acid, and terephthalic acid, and their anhydrides; alkyldicarboxylic acids such as succinic acid, adipic acid, sebacic acid, and azelaic acid, and their anhydrides; succinic acid substituted by a $C_{6-18}$ alkyl group or $C_{6-18}$ alkenyl group, and anhydrides thereof; and unsaturated dicarboxylic acids such as fumaric acid, maleic acid, and citraconic acid, and their anhydrides.

The following monomers can be used in addition to the preceding:

polyhydric alcohols such as the oxyalkylene ethers of novolac-type phenolic resins; polybasic carboxylic acids, e.g., trimellitic acid, pyromellitic acid, and benzophenonetetracarboxylic acid, and their anhydrides.

Among the preceding, either the carboxylic acid monomer or alcohol monomer preferably has an aromatic ring. The presence of the aromatic ring can bring about a reduction in the crystallinity of the polyester resin and an increase in the solubility in solvent.

[Solvent]

There are no particular limitations on the aforementioned solvent as long as it is a solvent capable of dissolving the resin.

Examples here are ethers such as tetrahydrofuran; ketones such as methyl ethyl ketone and cyclohexanone; esters such as ethyl acetate; and halides such as chloroform.

In addition, the solvent may be an aromatic hydrocarbon, e.g., toluene, benzene, and so forth, when the aromatic hydrocarbon has the ability to dissolve the resin.

[Pigment]

There are no particular limitations on the pigment, and, for example, any generally commercially available organic pigment, inorganic pigment, or pigment dispersed in, e.g., an insoluble resin as a dispersion medium, or pigment having a resin grafted to its surface can be used.

These pigments can be exemplified by the pigments described in "Dictionary of Pigments" (published 2000), compiled by Seishiro Ito; "Industrial Organic Pigments", W. Herbst and K. Hunger; and Japanese Patent Application Laid-open Nos. 2002-12607, 2002-188025, 2003-26978, and 2003-342503.

The following are specific examples of pigments that present a yellow color:

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Pigments that present a red or magenta color can be exemplified by the following:

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

Pigments that present a blue or cyan color can be exemplified by the following:

C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Pigments that present a green color can be exemplified by the following:

C. I. Pigment Green 7, 8, and 36.

Pigments that present an orange color can be exemplified by the following:

C. I. Pigment Orange 66 and 51.

Pigments that present a black color can be exemplified by the following:

carbon black, titanium black, and aniline black.

The following are specific examples of white pigments:

basic lead carbonate, zinc oxide, titanium oxide, and strontium titanate.

A dispersing device, for example, a ball mill, sand mill, attritor, roll mill, jet mill, homogenizer, paint shaker, kneader, agitator, Henschel mixer, colloid mill, ultrasonic homogenizer, pearl mill, wet jet mill, and so forth, can be used to disperse the pigment.

The amount of addition of the pigment, expressed per 100 mass parts of the resin, is preferably 1 to 100 mass parts and is more preferably 5 to 50 mass parts.

[Pigment Dispersing Agent]

A pigment dispersing agent or pigment dispersing aid may also be used in the present invention when pigment dispersion is carried out.

The pigment dispersing agent can be exemplified by hydroxyl group-bearing carboxylate esters, the salts of long-chain polyaminoamides and high molecular weight acid esters, the salts of high molecular weight polycarboxylic acids, high molecular weight unsaturated acid esters, high molecular weight copolymers, polyesters and modifications thereof, modified polyacrylates, aliphatic polybasic carboxylic acids, naphthalenesulfonic acid/formalin condensates, polyoxyethylene alkyl phosphate esters, and pigment derivatives.

A commercial pigment dispersing agent, e.g., the Solsperse series from The Lubrizol Corporation, can also be used. A synergist adapted to the particular pigment may also be used.

These pigment dispersing agents and pigment dispersing aids are preferably added at 1 to 100 mass parts per 100 mass parts of the pigment.

The method of adding the pigment dispersing agent is not particularly limited, but addition at the pigment dispersion step is preferred from the standpoint of pigment dispersibility.

[Toner Particle Dispersing Agent]

A toner particle dispersing agent can also be used in the present invention. A toner particle dispersing agent promotes toner particle formation and brings about a stable dispersion of the toner particles in the curable insulating liquid.

When the liquid developer is produced using the aforementioned coacervation method, dispersing the colored resin particles in the curable insulating liquid in the presence of a toner particle dispersing agent makes it possible to further increase the dispersion stability of the colored resin particles in the curable insulating liquid. The charging characteristics and electrophoretic characteristics of the colored resin particles can also be improved.

This toner particle dispersing agent should be able to bring about a stable dispersion of the toner particles, but its type is not otherwise particularly limited. In addition, it may dissolve in the curable insulating liquid or may disperse therein without dissolving.

A single toner particle dispersing agent may be used by itself or two or more may be used in combination.

This toner particle dispersing agent can be exemplified by Ajisper PB817 (Ajinomoto Co., Inc.) and Solsperse 11200, 13940, 17000, and 18000 (Lubrizol Japan Ltd.).

The toner particle dispersing agent may be added in the range from 0.5 to 30 mass parts per 100 mass parts of the toner particle. By use in this range, the toner particle dispersibility is further improved while the fixing strength by the toner particle is maintained.

[Photoinitiator]

The photoinitiator in the present invention is a compound that reacts to light at a prescribed wavelength and thereby generates an acid or a radical. Known photoinitiators can be used without particular limitation as such a compound.

Cationic photoinitiators can be exemplified by onium salt compounds, sulfone compounds, sulfonate ester compounds, sulfonimide compounds, and diazomethane compounds, but are not limited to the preceding. In addition, radical photoinitiators can be exemplified by benzoin derivatives, but are not limited thereto.

When a cationic photoinitiator is used in the present invention, the photoinitiator given by the following formula (1), which provides little reduction in the volume resistivity of ultraviolet-curable insulating liquids, is then preferably used.

formula (1)

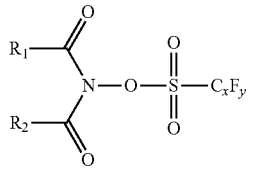

[In formula (1), $R_1$ and $R_2$ are bonded to each other to form a ring structure; x represents an integer from 1 to 8; and y represents an integer from 3 to 17.]

A photoinitiator with formula (1) undergoes photolysis upon exposure to ultraviolet radiation and generates a sulfonic acid, which is a strong acid. In addition, it may be used in combination with a sensitizer, in which case the absorption of ultraviolet radiation by the sensitizer acts as a trigger to cause decomposition of the polymerization initiator and production of the sulfonic acid.

The ring structure formed by the bonding of $R_1$ and $R_2$ can be exemplified by 5-membered rings and 6-membered rings. Specific examples of the ring structure formed by the bonding of $R_1$ and $R_2$ are succinimide structures, phthalimide structures, norbornene dicarboximide structures, naphthalene dicarboximide structures, cyclohexane dicarboximide structures, and epoxycyclohexene dicarboximide structures.

These ring structures may also have a substituent, for example, an alkyl group, alkyloxy group, alkylthio group, aryl group, aryloxy group, arylthio group, and so forth.

The $C_xF_y$ in formula (1) can be exemplified by linear-chain alkyl groups in which the hydrogen atom has been substituted by the fluorine atom (RF1), branched-chain alkyl groups in which the hydrogen atom has been substituted by the fluorine atom (RF2), cycloalkyl groups in which the hydrogen atom has been substituted by the fluorine atom (RF3), and aryl groups in which the hydrogen atom has been substituted by the fluorine atom (RF4).

The linear-chain alkyl groups in which the hydrogen atom has been substituted by the fluorine atom (RF1) can be exemplified by the trifluoromethyl group (x=1, y=3), pentafluoroethyl group (x=2, y=5), heptafluoro-n-propyl group (x=3, y=7), nonafluoro-n-butyl group (x=4, y=9), perfluoro-n-hexyl group (x=6, y=13), and perfluoro-n-octyl group (x=8, y=17).

The branched-chain alkyl groups in which the hydrogen atom has been substituted by the fluorine atom (RF2) can be exemplified by the perfluoroisopropyl group (x=3, y=7), perfluoro-tert-butyl group (x=4, y=9), and perfluoro-2-ethylhexyl group (x=8, y=17).

The cycloalkyl groups in which the hydrogen atom has been substituted by the fluorine atom (RF3) can be exemplified by the perfluorocyclobutyl group (x=4, y=7), perfluorocyclopentyl group (x=5, y=9), perfluorocyclohexyl group (x=6, y=11), and perfluoro(1-cyclohexyl)methyl group (x=7, y=13).

The aryl groups in which the hydrogen atom has been substituted by the fluorine atom (RF4) can be exemplified by the pentafluorophenyl group (x=6, y=5) and 3-trifluoromethyltetrafluorophenyl group (x=7, y=7).

For the $C_xF_y$ in formula (1), the linear-chain alkyl groups (RF1), branched-chain alkyl groups (RF2), and aryl groups (RF4) are preferred from the standpoint of the ease of acquisition and the decomposability of the sulfonate ester moiety. The linear-chain alkyl groups (RF1) and aryl groups (RF4) are more preferred. The trifluoromethyl group (x=1, y=3), pentafluoroethyl group (x=2, y=5), heptafluoro-n-propyl group (x=3, y=7), nonafluoro-n-butyl group (x=4, y=9), and pentafluorophenyl group (x=6, y=5) are particularly preferred.

A single photoinitiator can be used or two or more can be used in combination. The content of the photoinitiator in the ultraviolet-curable liquid developer composition of the present invention is not particularly limited, but, expressed per 100 mass parts of the polymerizable liquid monomer, is preferably at least 0.01 mass parts and not more than 5 mass parts, more preferably at least 0.05 mass parts and not more than 1 mass parts, and even more preferably at least 0.1 mass parts and not more than 0.5 mass parts.

The following are specific examples [example compounds A-1 to A-27] of the photoinitiator with formula (1), but the present invention is not limited to or by these examples.

(A-1)

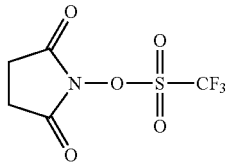

(A-2)

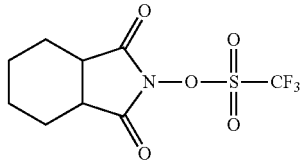

(A-3)

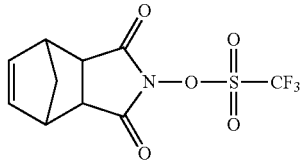

(A-4)

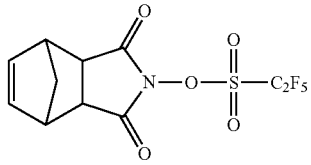

(A-5)

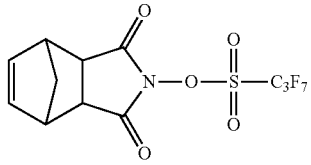

(A-6)

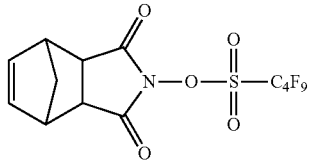

(A-7)

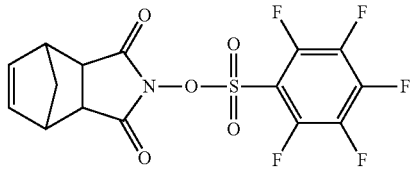

(A-8)

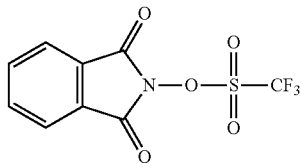

-continued
(A-9)
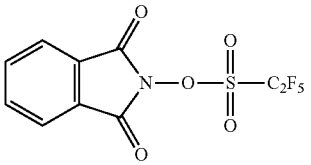
(A-10)
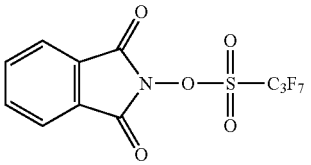
(A-11)
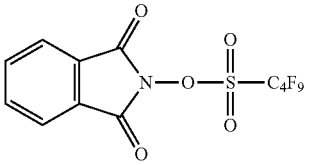
(A-12)
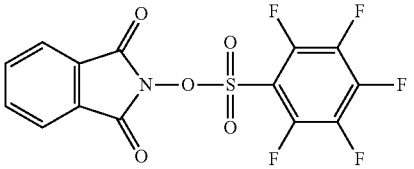
(A-13)
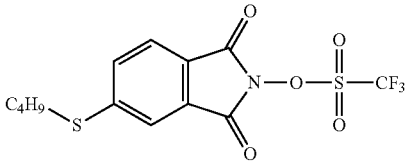
(A-14)
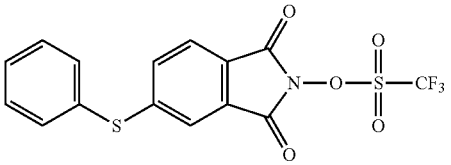
(A-15)
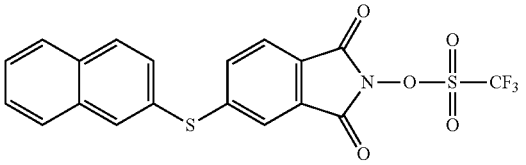
(A-16)
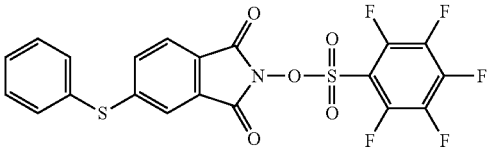
(A-17)
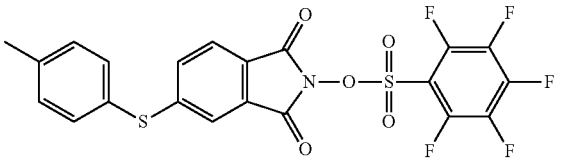
-continued
(A-18)
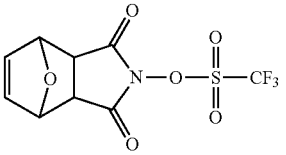
(A-19)
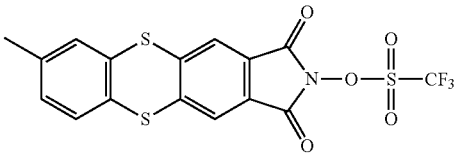
(A-20)
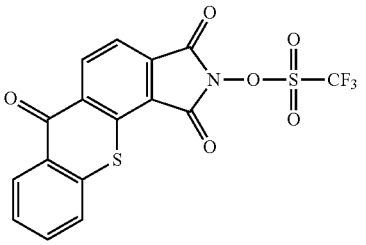
(A-21)
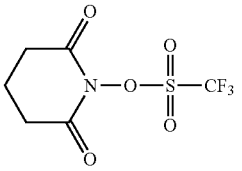
(A-22)
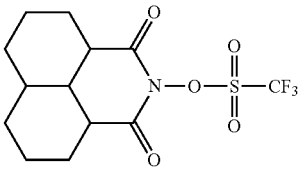
(A-23)
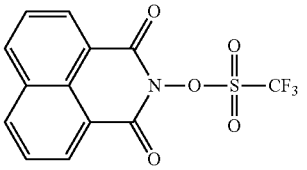
(A-24)
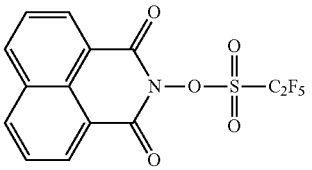
(A-25)
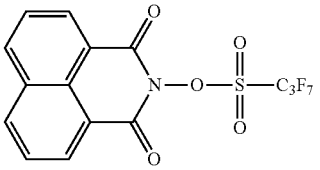

-continued (A-26)

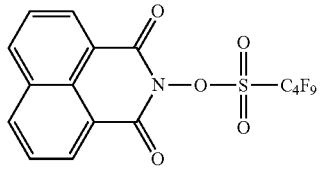

(A-27)

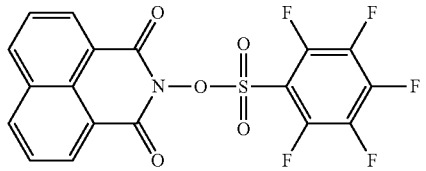

[Additives]

The curable liquid developer of the present invention may as necessary contain additives such as those described in the following.

[Sensitizer]

As necessary, a sensitizer may be added to the curable liquid developer of the present invention with the goals of, for example, improving the acid-generating efficiency of the photoinitiator and extending the photosensitive wavelengths to longer wavelengths.

There are no particular limitations on the sensitizer other than that it should be capable of sensitizing the photoinitiator through an electron transfer mechanism or energy transfer mechanism.

Specific examples are aromatic polycondensed ring compounds such as anthracene, 9,10-dialkoxyanthracene, pyrene, and perylene; aromatic ketone compounds such as acetophenone, benzophenone, thioxanthone, and Michler's ketone; and heterocyclic compounds such as phenothiazine and N-aryloxazolidinone.

The sensitizer content is selected as appropriate in correspondence to the goal, but, per 1 mass parts of the photoinitiator, is generally 0.1 to 10 mass parts and preferably 1 to 5 mass parts.

A sensitizing aid may also be added to the ultraviolet-curable liquid developer of the present invention with the goal of improving the electron transfer efficiency or energy transfer efficiency between the aforementioned sensitizer and the photoinitiator.

Specific examples are naphthalene compounds such as 1,4-dihydroxynaphthalene, 1,4-dimethoxynaphthalene, 1,4-diethoxynaphthalene, 4-methoxy-1-naphthol, and 4-ethoxy-1-naphthol, and benzene compounds such as 1,4-dihydroxybenzene, 1,4-dimethoxybenzene, 1,4-diethoxybenzene, 1-methoxy-4-phenol, and 1-ethoxy-4-phenol.

The sensitizing aid content is selected as appropriate in correspondence to the goal, but, per 1 mass parts of the sensitizer, is generally 0.1 to 10 mass parts and preferably 0.5 to 5 mass parts.

[Cationic Polymerization Inhibitor]

A cationic polymerization inhibitor may also be added to the curable liquid developer of the present invention.

The cationic polymerization inhibitor can be exemplified by alkali metal compounds and/or alkaline-earth metal compounds and by amines.

The amines can be exemplified by alkanolamines, N,N-dimethylalkylamines, N,N-dimethylalkenylamines, and N,N-dimethylalkynylamines.

Specific examples are triethanolamine, triisopropanolamine, tributanolamine, N-ethyldiethanolamine, propanolamine, n-butylamine, sec-butylamine, 2-aminoethanol, 2-methylaminoethanol, 3-methylamino-1-propanol, 3-methylamino-1,2-propanediol, 2-ethylaminoethanol, 4-ethylamino-1-butanol, 4-(n-butylamino)-1-butanol, 2-(t-butylamino)ethanol, N,N-dimethylundecanolamine, N,N-dimethyldodecanolamine, N,N-dimethyltridecanolamine, N,N-dimethyltetradecanolamine, N,N-dimethylpentadecanolamine, N,N-dimethylnonadecylamine, N,N-dimethylicosylamine, N,N-dimethyleicosylamine, N,N-dimethylheneicosylamine, N,N-dimethyldocosylamine, N,N-dimethyltricosylamine, N,N-dimethyltetracosylamine, N,N-dimethylpentacosylamine, N,N-dimethylpentanolamine, N,N-dimethylhexanolamine, N,N-dimethylheptanolamine, N,N-dimethyloctanolamine, N,N-dimethylnonanolamine, N,N-dimethyldecanolamine, N,N-dimethylnonylamine, N,N-dimethyldecylamine, N,N-dimethylundecylamine, N,N-dimethyldodecylamine, N,N-dimethyltridecylamine, N,N-dimethyltetradecylamine, N,N-dimethylpentadecylamine, N,N-dimethylhexadecylamine, N,N-dimethylheptadecylamine, and N,N-dimethyloctadecylamine. In addition to these, for example, a quaternary ammonium salt may also be used. The cationic polymerization inhibitor is particularly preferably a secondary amine.

The content of the cationic polymerization inhibitor is preferably 1 to 5,000 ppm on a mass basis in the curable liquid developer.

[Radical Polymerization Inhibitor]

A radical polymerization inhibitor may be added to the curable liquid developer of the present invention.

For example, in the case of a curable liquid developer that contains a vinyl ether compound, during storage the photoinitiator may undergo a trace decomposition and thereby convert into a radical compound and a polymerization caused by this radical compound may then be induced. A radical polymerization inhibitor is desirably added to prevent this.

Usable radical polymerization inhibitors can be exemplified by phenolic hydroxy group-containing compounds; quinones such as methoquinone (hydroquinone monomethyl ether), hydroquinone, and 4-methoxy-1-naphthol; hindered amine antioxidants; 1,1-diphenyl-2-picrylhydrazyl free radical; N-oxyl free radical compounds; nitrogen-containing heterocyclic mercapto compounds; thioether antioxidants; hindered phenol antioxidants; ascorbic acids; zinc sulfate; thiocyanates; thiourea derivatives; saccharides; phosphoric acid-type antioxidants; nitrites; sulfites; thiosulfates; hydroxylamine derivatives; aromatic amines; phenylenediamines; imines; sulfonamides; urea derivatives; oximes; polycondensates of dicyandiamide and polyalkylenepolyamine; sulfur-containing compounds such as phenothiazine; complexing agents based on tetraazaannulene (TAA); and hindered amines.

Phenolic hydroxy group-containing compounds, N-oxyl free radical compounds, 1,1-diphenyl-2-picrylhydrazyl free radical, phenothiazine, quinones, and hindered amines are preferred from the standpoint of preventing the curable liquid developer from undergoing a viscosity increase. N-oxyl free radical compounds are more preferred.

The content of the radical polymerization inhibitor is preferably 1 to 5,000 ppm on a mass basis in the curable liquid developer.

[Charge Control Agent]

The curable liquid developer of the present invention may as necessary contain a charge control agent. A known charge control agent can be used.

Examples of specific compounds are as follows:

fats and oils such as linseed oil and soy oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octylate, nickel octylate, zinc octylate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin; metal salicylates such as metal t-butylsalicylate complexes; polyvinylpyrrolidone resins; polyamide resins; sulfonic acid-containing resins; and hydroxybenzoic acid derivatives.

[Charge Adjuvant]

A charge adjuvant can as necessary be incorporated in the toner particle in the present invention. A known charge adjuvant can be used.

Examples of specific compounds are as follows: metal soaps such as zirconium naphthenate, cobalt naphthenate, nickel naphthenate, iron naphthenate, zinc naphthenate, cobalt octylate, nickel octylate, zinc octylate, cobalt dodecanoate, nickel dodecyl acid, zinc dodecyl acid, aluminum stearate, aluminum tristearate, and cobalt 2-ethylhexanoate; metal sulfonates such as petroleum-based metal sulfonates and the metal salts of sulfosuccinate esters; phospholipids such as lecithin and hydrogenated lecithin; metal salicylates such as metal t-butylsalicylate complexes; polyvinylpyrrolidone resins; polyamide resins; sulfonic acid-containing resins; and hydroxybenzoic acid derivatives.

[Other Additives]

In addition to those described above, various known additives may as necessary be incorporated in the curable liquid developer of the present invention with the goal of improving the compatibility with recording media, the storage stability, the image storability, and other characteristics. Examples here are surfactant, lubricant, filler, antifoaming agent, ultraviolet absorber, antioxidant, anti-fading agent, fungicide, anticorrosion agent, and so forth, and these can be selected as appropriate and used.

The curable liquid developer of the present invention is electrostatically transferred onto a recording medium and is subsequently cured and fixed by the irradiation with energy.

[Image-Forming Method]

The image-forming method of the present invention contains a latent image formation step of forming an electrostatic latent image on a surface of an image bearing member; a developing step of forming an image by developing, with a curable liquid developer, the electrostatic latent image formed on the surface of the image bearing member; a transfer step of transferring, onto a recording medium, the image formed on the surface of the image bearing member; and a fixing step of curing the image transferred to the recording medium in order to fix the image to the recording medium, wherein the curable liquid developer is the curable liquid developer of the present invention and the toner particle concentration in the image transferred to the recording medium is at least 40 mass % and not more than 80 mass %.

The aforementioned image is preferably cured by exposure to light and is more preferably cured by exposure to ultraviolet radiation.

In the present invention, the toner particle concentration in the image transferred to the recording medium is preferably at least 40 mass % and not more than 80 mass % and is more preferably at least 50 mass % and not more than 70 mass %.

When the toner particle concentration is less than 40 mass %, the concentration of the colored material in the fixed image is reduced and a reduction in the image density is seen.

When, on the other hand, the toner particle concentration exceeds 80 mass %, there is deficient curable insulating liquid for the fixed image and curing is then inadequate.

[Image-Forming Apparatus]

The curable liquid developer of the present invention can be advantageously used in common or ordinary image-forming apparatuses that employ an electrophotographic system.

The application of the curable liquid developer of the present invention to an electrophotographic image-forming apparatus that is a liquid image-forming apparatus (referred to in the following simply as an image-forming apparatus) is described in the following as an exemplary embodiment.

FIG. 1 is a schematic structural diagram of the main part of the image-forming apparatus according to the present embodiment.

The image-forming apparatus is constituted of image-forming units 50C, 50M, 50Y, 50K; primary transfer units 60C, 60M, 60Y, 60K; a secondary transfer unit 30; and a developer-curing unit 90.

The image-forming units 50C, 50M, 50Y, 50K respectively function to develop a latent image with a cyan (C) liquid developer, a magenta (M) liquid developer, a yellow (Y) liquid developer, and a black (K) liquid developer.

The image-forming units 50C, 50M, 50Y, 50K have structures comprising a photosensitive member 52C, 52M, 52Y, 52K and a development liquid supply pump 13C, 13M, 13Y, 13K—which supplies a developing unit 51C, 51M, 51Y, 51K with the respective liquid developer from a developer container 10C, 10M, 10Y, 10K that stores the particular liquid developer—wherein a charging device, a photoexposure device, a cleaning unit, and a static eliminator are disposed around these photosensitive members.

The image-forming units 50C, 50M, 50Y, 50K all have the same structure, and the following description therefore continues with reference to the image-forming unit 50C.

Figure 2:
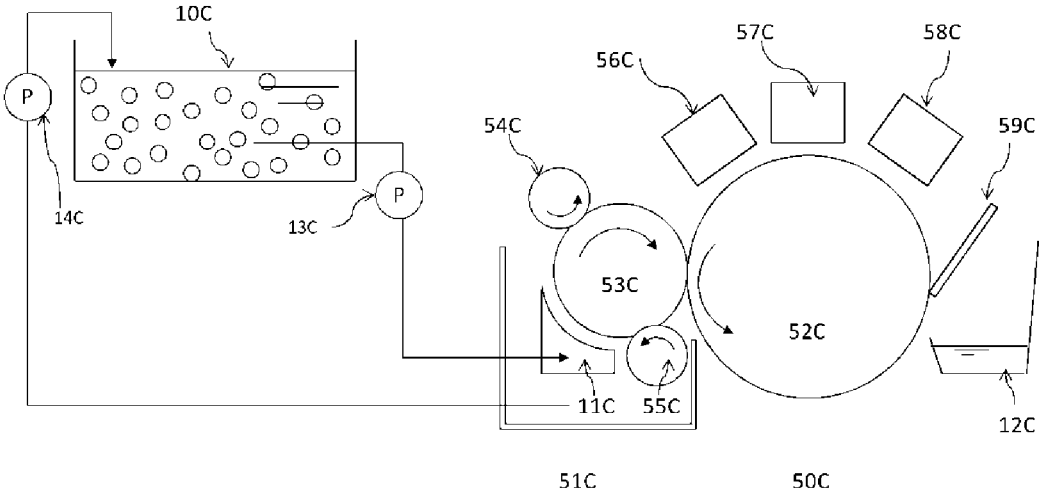
FIG. 2 is a cross-sectional diagram of an image-forming unit.

FIG. 2 gives a cross-sectional view of the image-forming unit 50C. A charging unit 57C, a photoexposure unit 56C, a developing unit 51C, a primary transfer unit 60C (FIG. 1), a recovery blade 59C, and a static-eliminating unit 58C are disposed along the direction of rotation of the photosensitive member 52C. The photosensitive member 52C has a cylindrical substrate and a photosensitive layer formed on the outer periphery thereof; is rotatable centered on a central axis; and undergoes counterclockwise rotation in the present embodiment. The surface of the photosensitive member 52C is formed of amorphous silicon (a-Si). For example, an organic photoconductor (OPC) and so forth can also be used for the material of the photosensitive member.

The charging unit 57C is an apparatus for charging the photosensitive member 52C. A corotron charging device or a roller charging device can be used.

The photoexposure unit 56C has a semiconductor laser, a polygon mirror, an F-θ lens, and so forth, and forms a latent image by irradiating a modulated laser onto the charged photosensitive member 52C. A light-emitting diode (LED) or organic light-emitting diode (OLED) can also be disposed as the laser light source.

The static-eliminating unit 58C is a device for neutralizing the photosensitive member 52C. A corona discharge-type charging device or a roller contact-type charging device can be used.

The recovery blade 59C is constituted of a rubber part of, e.g., a urethane rubber, which contacts the surface of the photosensitive member 52C, and of a plate of, e.g., a metal, which supports the rubber part, and removes the liquid developer remaining on the photosensitive member 52C by scraping it into a recovery unit 12C.

The developing unit 51C is constituted of a development roller 53C, a concentration roller 54C, a cleaning roller 55C, and a film-production counterelectrode 11C.

The development roller 53C is a cylindrical member and rotates centered on a central axis in the opposite direction from the photosensitive member 52C as shown in FIG. 2. The development roller 53C is provided with an elastic member, e.g., a conductive urethane rubber, and a resin layer or rubber layer on the outer circumference of an inner core of a metal such as, e.g., iron.

The film-production counterelectrode 11C is disposed with a gap of at least 100 μm or more with the development roller 53C and is constituted of a metal member.

The concentration roller 54C is a cylindrical member and rotates centered on a central axis in the opposite direction from the development roller 53C as shown in FIG. 2. The concentration roller 54C is formed of a metal such as, e.g., iron.

The cleaning roller 55C is a cylindrical member and rotates centered on a central axis in the opposite direction from the development roller 53C as shown in FIG. 2.

The developer container 10C stores a cyan liquid developer for developing the latent image formed on the photosensitive member 52C. The concentration-adjusted liquid developer is fed from the developer container 10C, through a connection conduit in which the development liquid supply pump 13C is disposed, to the developing unit 51C, while the residual developer is returned to the developer container 10C through a connection conduit in which a developer recovery pump 14C is disposed. The toner particle concentration in the liquid developer in the developer container 10C is adjusted at least to 2 mass % or more.

The liquid developer having an adjusted toner particle concentration is fed to between the rotating development roller 53C and the film-production counterelectrode 11C, and the liquid developer is coated on the development roller 53C by establishing a bias between the development roller 53C and the film-production counterelectrode 11C. The bias is made at least 100 V or more, and a bias up to the discharge limit can be established.

The residual fraction of the supplied liquid developer is recovered from a recovery unit 12C through a connection conduit that incorporates a recovery pump and is supplied to a recovery tank (not shown) and is re-used.

The primary transfer unit 60C, 60M, 60Y, 60K is constructed of an intermediate transfer belt 40, a primary transfer roller 61C, 61M, 61Y, 61K, and the photosensitive member 52C, 52M, 52Y, and 52K. The intermediate transfer belt 40 is an endless belt tensioned by a belt driver roller 41 and a driven roller 42 and is driven rotationally while in contact with the photosensitive members 52C, 52M, 52Y, 52K.

A full-color image is formed by the successive transfer of the four liquid developer colors onto the intermediate transfer belt 40 by the primary transfer units 60C, 60M, 60Y, 60K constituted of the intermediate transfer belt 40, the primary transfer rollers 61C, 61M, 61Y, 61K, and the photosensitive members 52C, 52M, 52Y, and 52K.

A secondary transfer unit 30 is constituted of the belt driver roller 41, a secondary transfer roller 31, a pre-wet roller 20, and a pre-wet counter-roller 21, and transfers, onto the recording medium 80, e.g., paper, the single-color liquid developer image or full-color liquid developer image formed on the intermediate transfer belt 40.

The pre-wet roller 20 is a cylindrical member and rotates centered on a central axis in the opposite direction from the intermediate transfer belt 40 as shown in FIG. 1.

After transport from a carrier tank (not shown) to the pre-wet roller 20 and the formation of a carrier film of not more than 1.0 μm on the surface, the amount of the liquid film of the single-color liquid developer image or full-color liquid developer image is adjusted by causing the pre-wet roller 20 to contact the single-color liquid developer image or full-color liquid developer image formed on the intermediate transfer belt 40.

A developer curing unit 90 irradiates light, e.g., ultraviolet radiation, on the single-color liquid developer image or full-color liquid developer image transferred onto the recording medium 80, causing the reactive functional groups to react and thereby effecting curing. The curing unit is constructed of an LED lamp, but there is no limitation to an LED as long as the device can irradiate ultraviolet radiation, and a heating apparatus, an EB-irradiating apparatus, and so forth can also be used.

[Light Source]

The image is fixed by curing the curable liquid developer of the present invention through application of energy thereto immediately after transfer to a recording medium.

The energy source used by the present invention is not particularly limited, but ultraviolet radiation is favorably used. For example, a mercury lamp, metal halide lamp, excimer laser, ultraviolet laser, cold cathode tube, hot cathode tube, black light, or light-emitting diode (LED) is usable as the light source here for carrying out ultraviolet irradiation, and a strip-shaped metal halide lamp, cold cathode tube, hot cathode tube, mercury lamp, black light, or LED is preferred.

The ultraviolet dose is preferably from 0.1 to 1,000 $mJ/cm^2$.

The measurement methods used in the present invention are given in the following.

<Method for Toner Particle Separation from the Liquid Developer>

Toner particle separation from the liquid developer is carried out by centrifugal separation and washing.

Specifically, 50 mL of the liquid developer is introduced into a centrifuge tube and a centrifugal separation process is carried out using a centrifugal separator (Allegra 64R Centrifuge, Beckman Coulter, Inc.) and conditions of 15,000 rpm and 10 minutes.

Toner particle sedimentation is confirmed and the supernatant is removed by decantation and an amount of hexane equal to the removed supernatant is added. Thorough washing with the hexane is carried out by stirring for 5 minutes with a spatula, followed by carrying out the centrifugal separation process under the same conditions. Hexane addition and removal is performed three times followed by evaporation of the hexane at room temperature to obtain toner particles.

<Method for Measuring the Volume-Average Particle Diameter [D50] of Particles>

The volume-average particle diameter [D50] of, e.g., the toner particles, is measured using a laser diffraction/scattering particle size distribution analyzer (LA-950, Horiba, Ltd.) in accordance with the operating manual provided with the instrument.

The method for measuring the toner particles in the liquid developer is as follows.

20 μL of the liquid developer is diluted with 20 mL heptane and a dispersion treatment is carried out for 2 minutes using a "VS-150" desktop ultrasound cleaner/disperser (Velvo-Clear Co., Ltd.) having an oscillation frequency of 50 kHz and an electrical output of 150 W to obtain a dispersion for measurement. During this, cooling is carried out as required to provide a dispersion temperature of at least 10° C. and not more than 40° C. A batch cell is used for the measurement, and the dispersion is introduced into the batch cell and the measurement is performed. After the measurement, washing with heptane is carried out three times following by washing twice with THF.

<Method for Measuring the Average Circularity of the Toner Particle>

The average circularity of the toner particle is measured using an "FPIA-3000" (Sysmex Corporation), a flow particle image analyzer, in accordance with the operating manual provided with the instrument.

The specific measurement method is as follows.

0.02 g of alkylbenzenesulfonate salt is added as a dispersing agent to 20 mL of deionized water followed by the addition of 0.02 g of the measurement sample and then the execution of a dispersion treatment for 2 minutes using a "VS-150" desktop ultrasound cleaner/disperser (Velvo-Clear Co., Ltd.) having an oscillation frequency of 50 kHz and an electrical output of 150 W to obtain a dispersion for measurement. During this, cooling is carried out as required to provide a dispersion temperature of at least 10° C. and not more than 40° C.

The measurement is carried out using the aforementioned flow particle image analyzer fitted with a standard objective lens (10×) and using "PSE-900A" Particle Sheath (Sysmex Corporation) for the sheath liquid. The dispersion prepared according to the procedure described above is introduced into the flow particle image analyzer and 3000 toner particles are measured in total count mode in HPF measurement mode. The average circularity of the toner particles is determined with the binarization threshold set to 85% during particle analysis and with the analyzed particle diameter limited to a circle-equivalent diameter of at least 0.25 μm and not more than 10 μm.

In addition, a scanning electron microscope (SEM) image can also be digitized by image analysis. Specifically, toner particle images are photographed using a scanning electron microscope (amplification: 10,000×); 100 toner particle images are randomly acquired with a scanner; and analysis is carried out with a "Luzex AP" image processing analyzer (Nireco Corporation) and calculation is performed by determining the average value here.

<Viscosity Measurement Method>

The viscosity is measured in the present invention by the rotational rheometer technique.

Specifically, the measurement is carried out as follows using a viscoelastic measurement instrument (Physica MCR300, Anton Paar GmbH).

(1) Method for Measuring the Viscosity of the Curable Insulating Liquid

Approximately 2 mL of the sample is filled into the measurement instrument fitted with a cone/plate measurement fixture (75 mm diameter, 1°) and adjustment to 25° C. is carried out. The viscosity is measured while continuously varying the shear rate from 1000 $s^{-1}$ to 10 $s^{-1}$, and the value at 10 $s^{-1}$ is used as the viscosity.

(2) Method for Measuring the Viscosity at a Toner Particle Concentration in the Liquid Developer of 1 mass % or 50 mass %

A solid/liquid separation is carried out on the toner particles in the liquid developer and a liquid developer (sample) is then prepared that has a toner particle concentration adjusted to 1 mass % or 50 mass %.

Specifically, 50 mL of the liquid developer is introduced into a centrifuge tube and a centrifugal separation process is carried out using a centrifugal separator (Allegra 64R Centrifuge, Beckman Coulter, Inc.) and conditions of 15,000 rpm and 10 minutes.

Toner particle sedimentation is confirmed and the supernatant is removed by decantation and an amount of hexane equal to the removed supernatant is added. Thorough washing with the hexane is carried out by stirring for 5 minutes with a spatula, followed by carrying out the centrifugal separation process under the same conditions. Hexane addition and removal is performed three times followed by evaporation of the hexane at room temperature to obtain toner particles. A liquid developer (sample) is then prepared by the addition of the curable insulating liquid so as to provide a toner particle concentration of 1 mass % or 50 mass %.

For each of the obtained samples, approximately 2 mL of the sample is filled into the measurement instrument fitted with a cone/plate measurement fixture (75 mm diameter, 1°) and adjustment to 25° C. is carried out. The viscosity is measured while continuously varying the shear rate from 1000 $s^{-1}$ to 10 $s^{-1}$, and the value at 10 $s^{-1}$ is used as the viscosity.

The value of (A−B) is then determined, i.e., the value yielded by subtracting B from A where A (mPa·s) is the viscosity of the curable liquid developer at 25° C. when the toner particle concentration in the curable liquid developer is 50 mass % and B (mPa·s) is the viscosity of the curable liquid developer at 25° C. when the toner particle concentration in the curable liquid developer is 1 mass %.

<Method for Measuring the Volume Resistivity>

The volume resistivity is measured in the present invention by the impedance method.

Specifically, the measurement is carried out as follows using a dielectric measurement system (125596WB, Solartron).

A measurement cell (SC-C1R-C, Toyo Corporation) filled with 1.2 mL of the sample is connected to the measurement instrument and adjustment to 25° C. is carried out. The measurement is carried out at an applied voltage of 3 V (effective value) while varying the frequency in the range from 1 MHz to 0.1 Hz. The obtained complex impedance is reported as a Nyquist plot, and the values of the resistive component and capacitive component of the sample are calculated by fitting with an equivalent RC parallel circuit. In addition, the volume resistivity is determined from the cell constant of the measurement cell.

<Method for Measuring the Molecular Weight>

The molecular weight of the resins and so forth is determined as polystyrene using gel permeation chromatography (GPC). Measurement of the molecular weight by GPC is carried out as follows.

A solution is prepared by adding the sample to the eluent indicated below to provide a sample concentration of 1.0 mass % and dissolving by standing for 24 hours at room temperature. This solution is filtered across a solvent-resistant membrane filter with a pore diameter of 0.20 μm to obtain the sample solution, and measurement is performed under the following conditions.

instrument: "HLC-8220GPC" high-performance GPC instrument [Tosoh Corporation]
column: 2×LF-804
eluent: tetrahydrofuran (THF)
flow rate: 1.0 mL/minute
oven temperature: 40° C.
sample injection amount: 0.025 mL The molecular weight calibration curve used to determine the molecular weight of the sample is constructed using polystyrene resin standards [TSK Standard Polystyrene F-850, F-450, F-288, F-128, F-80, F-40, F-20, F-10, F-4, F-2, F-1, A-5000, A-2500, A-1000, and A-500, from the Tosoh Corporation].

EXAMPLES

The present invention is described in detail by the following examples, but the present invention is not limited to or by these examples. Unless specifically indicated otherwise, and "parts" denotes "mass %" and "mass parts", respectively.

<Synthesis of Pigment Dispersing Agent>

100 mass parts of a toluene solution (solids fraction=50%) of an isocyanate group-bearing polycarbodiimide compound having a carbodiimide equivalent weight of 262 and 8.5 mass parts of N-methyldiethanolamine were charged and held for 3 hours at approximately 100° C. to react the isocyanate group and hydroxyl group.

39.6 mass parts of a terminal carboxyl group-bearing ϵ-caprolactone self-polycondensate having a number-average molecular weight of 8,500 was then charged; the carbodiimide group and carboxyl group were reacted by holding for 2 hours at approximately 80° C.; and the toluene was then removed by distillation under reduced pressure to obtain a pigment dispersing agent (solids fraction=100%) having a number-average molecular weight of approximately 13,000.

Example 1 pigment: 10 mass parts
(Carbon Black MA-7, Mitsubishi Chemical Corporation)
pigment dispersing agent: 10 mass parts
solvent (tetrahydrofuran "THF"): 80 mass parts were mixed and were kneaded for 1 hour with a paint shaker using steel beads having a diameter of 5 mm to obtain a kneaded material 1.
obtained kneaded material 1: 60 mass parts
polyester resin 1: 80 mass parts
[50 mass % THF solution of polyoxypropylene(2.0)-2,2-bis(4-hydroxyphenyl)propane:terephthalic acid:trimellitic acid=(molar ratio) 50:40:10, weight-average molecular weight (Mw)=10,500]
toner particle dispersing agent: 12 mass parts
(Ajisper PB-817, Ajinomoto Co., Inc.)
were mixed using a high-speed disperser (T.K. Robomix/T.K. Homodisper Model 2.5 blade, Primix Corporation) and mixing was performed while stirring at 40° C. to obtain a pigment dispersion 1.

While carrying out high-speed stirring (25,000 rpm) using a homogenizer (Ultra-Turrax T50, IKA), a mixture 1 was obtained by adding 200 mass parts of dodecyl vinyl ether (DDVE), a curable insulating liquid (polymerizable liquid monomer), in small portions to the pigment dispersion 1 (100 mass parts) obtained as above.

The obtained mixture 1 was transferred to a recovery flask and the THF was completely distilled off at 50° C. while carrying out ultrasound dispersion to obtain a toner particle dispersion 1 that contained toner particles in the curable insulating liquid.

The obtained toner particle dispersion 1 (10 mass parts) was submitted to a centrifugal separation process; the supernatant was removed by decantation; replacement was performed with fresh DDVE in a mass equal to that of the removed supernatant; and redispersion was carried out.

After this, 0.10 mass parts of Lecinol S-10 (hydrogenated lecithin, Nikko Chemicals Co., Ltd.), 90 mass parts of dipropylene glycol divinyl ether as a curable insulating liquid (polymerizable liquid monomer), 0.30 mass parts of the photoinitiator given by the following formula (A-3), and 1 mass parts of KAYAKURE-DETX-2 (Nippon Kayaku Co., Ltd.) were added to obtain a curable liquid developer 1.

(A-3)

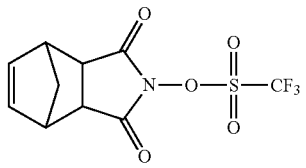

Example 2

A toner particle dispersion 2 and a curable liquid developer 2 were obtained proceeding as in Example 1, but changing the polyester resin 1 to a polyester resin 2 [50 mass % THF solution of polyoxypropylene(2.0)-2,2-bis(4-hydroxyphenyl)propane:terephthalic acid trimellitic acid=(molar ratio) 50:25:25, weight-average molecular weight (Mw)=17,400].

Example 3

A toner particle dispersion 3 and a curable liquid developer 3 were obtained proceeding as in Example 1, but changing the polyester resin 1 to a polyester resin 3 [50 mass % THF solution of polyoxypropylene(2.0)-2,2-bis(4-hydroxyphenyl)propane:terephthalic acid trimellitic acid=(molar ratio) 50:45:5, weight-average molecular weight (Mw)=13,100].

Example 4

A toner particle dispersion 4 and a curable liquid developer 4 were obtained proceeding as in Example 1, but changing the polyester resin 1 to a polyester resin 4 [50 mass % THF solution of polyoxypropylene(2.0)-2,2-bis(4-hydroxyphenyl)propane:terephthalic acid trimellitic acid=(molar ratio) 50:40:10, weight-average molecular weight (Mw)=6,100].

Example 5

A toner particle dispersion 5 and a curable liquid developer 5 were obtained proceeding as in Example 1, but changing the 12 mass parts of the toner particle dispersing agent (Ajisper PB-817, Ajinomoto Co., Inc.) to 10 mass parts.

Example 6

A toner particle dispersion 6 and a curable liquid developer 6 were obtained proceeding as in Example 1, but changing the rotation rate of the high speed stirring using the homogenizer (Ultra-Turrax T50, IKA) from 25,000 rpm to 15,000 rpm.

Example 7

A toner particle dispersion 7 and a curable liquid developer 7 were obtained proceeding as in Example 6, but changing the 12 mass parts of the toner particle dispersing agent (Ajisper PB-817, Ajinomoto Co., Inc.) to 10 mass parts.

Example 8

A toner particle dispersion 8 and a curable liquid developer 8 were obtained proceeding as in Example 1, but changing the polyester resin 1 to a polyester resin 5 [50 mass % THF solution of polyoxypropylene(2.0)-2,2-bis(4-hydroxyphenyl)propane:terephthalic acid=(molar ratio) 50:50, Mw=11,000], changing the toner particle dispersing agent from 12 mass parts of Ajisper (PB-817, Ajinomoto Co., Inc.) to 8 mass parts of Solsperse 13940 (Lubrizol Japan Ltd.), and changing the rotation rate of the high speed stirring using the homogenizer (Ultra-Turrax T50, IKA) from 25,000 rpm to 15,000 rpm.

Example 9

A toner particle dispersion 9 and a curable liquid developer 9 were obtained proceeding as in Example 8, but changing the 8 mass parts of the Solsperse 13940 (Lubrizol Japan Ltd.) to 4 mass parts.

Example 10

A toner particle dispersion 10 and a curable liquid developer 10 were obtained proceeding as in Example 9, but changing the polyester resin 5 to a polyester resin 6 [50 mass % THF solution of polyoxyethylene(2.0)-2,2-bis(4-hydroxyphenyl)propane terephthalic acid=(molar ratio) 50:50, Mw=21,000].

Example 11

A toner particle dispersion 11 and a curable liquid developer 11 were obtained proceeding as in Example 9, but changing the polyester resin 5 to a styrene-acrylic resin 1 [50 mass % THF solution of styrene:acrylic acid=(molar ratio) 80:20, weight-average molecular weight (Mw)=10,500].

Example 12

A toner particle dispersion 12 and a curable liquid developer 12 were obtained proceeding as in Example 10, but changing the dipropylene glycol divinyl ether used as the curable insulating liquid (polymerizable liquid monomer) to X22-163A (silicone modified by epoxy at both terminals, Shin-Etsu Chemical Co., Ltd.).

Example 13

A toner particle dispersion 13 and a curable liquid developer 13 were obtained proceeding as in Example 10, but changing the dipropylene glycol divinyl ether used as the curable insulating liquid (polymerizable liquid monomer) to trimethylolpropane triacrylate (A-TMPT, trifunctional acrylate, Shin-Nakamura Chemical Co., Ltd.) and changing the photoinitiator with formula (A-3) to IRGACURE (registered trademark) 369 (α-aminoalkylphenone-type radical photoinitiator, BASF Japan Ltd.).

Comparative Example 1

A resin solution was prepared by the addition of 5 mass parts of Neogen SC-F (DKS Co., Ltd.) as an emulsifying agent to the pigment dispersion 1 (100 mass parts) used in Example 1. This was followed by the addition of 100 mass parts of 1 N aqueous ammonia to the resin solution and thorough mixing with a high-speed disperser (T.K. Robomix/T.K. Homodisper Model 2.5 blade, Primix Corporation). While holding the temperature of the solution within the flask at 25° C., 80 mass parts of deionized water was added dropwise and, while continuing to stir, 20 mass parts of deionized water was added to produce, via the W/O emulsion, an O/W emulsion in which a resin material-containing dispersoid was dispersed.

This O/W emulsion was then transferred to a stirred container and, after bringing the temperature of the O/W emulsion to 25° C., 40 mass parts of a 5.0% aqueous sodium sulfate solution was added dropwise to carry out coalescence of the dispersoid and form coalesced particles. After the dropwise addition of the aqueous sodium sulfate solution, stirring was continued until the volume-average particle diameter (D50) [μm] for the coalesced particles had grown to 2.5 μm. Once the volume-average particle diameter (D50) of the coalesced particles had reached 2.5 μm, 20 mass parts of deionized water was added and the O/W emulsion containing the coalesced particles was placed under a reduced pressure environment and the organic solvent was distilled off to obtain a slurry (dispersion) of toner base particles.

Solid/liquid separation was carried out on the obtained slurry (dispersion) followed by redispersion (reslurrying) in water, and a washing process was carried out by performing the solid/liquid separation repeatedly.

This was followed by drying the obtained wet cake using a vacuum dryer to obtain dry toner particles.

A toner particle dispersion 14 was obtained by introducing 30 mass parts of the dry toner particles obtained by the method described in the preceding, 3 mass parts of a toner particle dispersing agent (Solsperse 13940, Lubrizol Japan Ltd.), and 70 mass parts of dodecyl vinyl ether (DDVE) into a ceramic pot; introducing zirconia balls (ball diameter: 1 mm) into the ceramic pot so as to provide a volume fill ratio of 85%; and carrying out dispersion for 24 hours at a rotation rate of 230 rpm in a desktop pot mill.

The obtained toner particle dispersion 14 (10 mass parts) was subjected to centrifugal separation; the supernatant was removed by decantation and replaced with fresh dodecyl vinyl ether (DDVE) in a mass equal to that of the removed supernatant; and redispersion was carried out.

A curable liquid developer 14 was subsequently obtained by the addition of 0.10 mass parts of Lecinol S-10 (hydrogenated lecithin, Nikko Chemicals Co., Ltd.), 90 mass parts of X22-163A (silicone modified by epoxy at both terminals, Shin-Etsu Chemical Co., Ltd.) as a curable insulating liquid (polymerizable liquid monomer), 0.30 mass parts of the photoinitiator given by formula (A-3) above, and 1 mass parts of KAYAKURE-DETX-S (Nippon Kayaku Co., Ltd.).

Comparative Example 2

The polyester resin 1 (67 mass parts), 10 mass parts of a pigment (Carbon Black MA-7, Mitsubishi Chemical Corporation), and 10 mass parts of a pigment dispersing agent (Vylon V-280, a polyester resin, Toyobo Co., Ltd.) were thoroughly mixed with a Henschel mixer and then melt-kneaded using a co-rotating twin-screw extruder at a roll interior heating temperature of 100° C.

The obtained kneaded material was cooled and then coarsely pulverized to obtain coarsely pulverized toner particles.

A toner particle dispersion 15 was then obtained by mixing 85 mass parts of dodecyl vinyl ether (DDVE), 15 mass parts of the coarsely pulverized toner particles obtained as described above, and 1.5 mass parts of a toner particle dispersing agent (Solsperse 13940, Lubrizol Japan Ltd.) for 24 hours with a sand mill.

The obtained toner particle dispersion 15 (10 mass parts) was subjected to centrifugal separation; the supernatant was removed by decantation and replaced with fresh DDVE in a mass equal to that of the removed supernatant; and redispersion was carried out.

A curable liquid developer 15 was then obtained by the addition of 0.10 mass parts of Lecinol S-10 (hydrogenated lecithin, Nikko Chemicals Co., Ltd.), 90 mass parts of dipropylene glycol divinyl ether as a curable insulating liquid (polymerizable liquid monomer), 0.30 mass parts of the photoinitiator given by formula (A-3) above, and 1 mass parts of KAYAKURE-DETX-S (Nippon Kayaku Co., Ltd.).

The viscosity at 25° C. of the curable insulating liquids used in the examples and comparative examples is given below.

dodecyl vinyl ether (DDVE): 2 mPa·s dipropylene glycol divinyl ether: 2 mPa·s

X22-163A (silicone modified by epoxy at both terminals, Shin-Etsu Chemical Co., Ltd.): 30 mPa·s trimethylolpropane triacrylate (A-TMPT, Shin-Nakamura Chemical Co., Ltd.): 42 mPa·s <Evaluations>

Each of the curable liquid developers was evaluated using the following evaluation methods. The results are given in Table 1.

<Transferability>

Using the image-forming apparatus shown in FIGS. 1 and 2, each of the obtained curable liquid developers was formed into an image on a polyethylene terephthalate (PET) sheet, and the pre-cure toner particle concentration on the PET sheet and the presence/absence of residual toner particles on the intermediate transfer belt 40 were checked.

The specific procedure is as follows.

(1) The development roller 53, photosensitive member 52, and primary transfer roller 61 were separated from each other and these were driven in a noncontact condition at different rotations in the directions of the arrows in FIG. 1. The rotation rate here was 250 mm/sec.

(2) The development roller 53 and the photosensitive member 52 were brought into contact at a pressing pressure of 5 N/cm and a bias was established using a DC power source. Since the developing bias is desirably in the range from 100 to 400 V, 200 V was used.

(3) The photosensitive member 52 and the primary transfer roller 61 were brought into contact at a prescribed pressing pressure and a bias was established using a DC power source. The transfer bias was made 1000 V.

(4) The secondary transfer unit 30 and the secondary transfer roller 31 were brought into contact at a prescribed pressing pressure and a bias was established using a DC power source. The transfer bias was made 1000 V.

(5) The curable liquid developer was supplied to the development liquid tank 10; an image was formed using a recording medium 80 provided by adhering a polyethylene terephthalate (PET) sheet (Teijin Limited, Panlite: PC-2151, thickness=0.3 mm) to a portion of OK Topcoat (Oji Paper Co., Ltd.); and evaluation was then carried out.

The toner particle concentration was measured by the following method.

The image on the PET sheet was dissolved and washed off with tetrahydrofuran (THF); the dissolution/wash solution was then measured using a thermogravimetric-differential thermal analysis (TG-DTA) instrument; and the toner particle concentration was determined from the percentage for the weight loss of the toner particle component in the range of 250° C. and above, versus the weight loss of the curable insulating liquid in the range from 100° C. to 200° C.

(Evaluation Criteria)

A: the toner particle concentration on the PET sheet was at least 60 mass % and almost no toner particles were seen to remain on the intermediate transfer belt B: the toner particle concentration on the PET sheet was at least 50 mass % and almost no toner particles were seen to remain on the intermediate transfer belt C: the toner particle concentration on the PET sheet was at least 40 mass % and toner particles were observed to remain on the intermediate transfer belt to a modest degree D: the toner particle concentration on the PET sheet was less than 40 mass % and toner particles were observed to remain on the intermediate transfer belt to a modest degree E: transfer could not be carried out <Fixing Performance>

A cured film was formed by irradiating the image formed in the evaluation of the transferability as described above with a dose of 150, 200, or 400 mJ/cm$^2$ from a high-pressure mercury lamp having a lamp output of 120 mW/cm$^2$. Immediately after curing the presence/absence of surface tack (stickiness) was checked by finger contact with the film surface. When the layer thickness of the image part is a thin film, curing is then possible at low energies and the fixing performance is improved.

(Evaluation Criteria)

A: tack is entirely undetected at a dose of 150 mJ/cm$^2$

B: tack is entirely undetected at a dose of 200 mJ/cm$^2$

C: tack is entirely undetected at a dose of 400 mJ/cm$^2$

D: tack was detected at a dose of 400 mJ/cm$^2$

E: the evaluation could not be performed

<Image Density>

A visual quality check was carried out on the image formed of a cured film and obtained in the preceding evaluation of the fixing performance.

A: a high-density, high-definition image was obtained

B: some worsening of the density occurred, but an image with a satisfactory density was obtained C: a decline in the image density was seen D: the evaluation could not be performed

TABLE 1

| | average circularity of toner particle | volume-average particle diameter of toner particle (μm) | viscosity of the curable insulating liquid (mPa · s) | A-B (mPa · s) | transfer-ability | fixing performance | image density |
|---|---|---|---|---|---|---|---|
| Example 1 | 0.975 | 0.9 | 2 | 100 | A | A | A |
| Example 2 | 0.975 | 0.9 | 2 | 100 | A | A | A |
| Example 3 | 0.975 | 1.0 | 2 | 100 | A | A | A |
| Example 4 | 0.975 | 0.9 | 2 | 100 | A | A | A |
| Example 5 | 0.974 | 1.2 | 2 | 100 | A | A | A |

TABLE 1-continued

| | average circularity of toner particle | volume-average particle diameter of toner particle (μm) | viscosity of the curable insulating liquid (mPa · s) | A-B (mPa · s) | transfer-ability | fixing performance | image density |
|---|---|---|---|---|---|---|---|
| Example 6 | 0.971 | 1.3 | 2 | 200 | A | B | A |
| Example 7 | 0.970 | 1.5 | 2 | 300 | A | B | A |
| Example 8 | 0.965 | 0.9 | 2 | 500 | B | B | A |
| Example 9 | 0.950 | 1.5 | 2 | 600 | B | B | A |
| Example 10 | 0.948 | 2.1 | 2 | 800 | C | B | B |
| Example 11 | 0.947 | 2.4 | 2 | 800 | C | B | B |
| Example 12 | 0.948 | 2.1 | 30 | 900 | C | C | B |
| Example 13 | 0.948 | 2.1 | 42 | 900 | C | C | B |
| Comparative Example 1 | 0.945 | 1.8 | 30 | 1500 | D | D | C |
| Comparative Example 2 | 0.935 | 1.1 | 2 | >10000 | E | E | D |

The results in Table 1 demonstrate that a satisfactory electrostatic transfer could not be achieved in the prior art Comparative Examples 1 and 2. In contrast to this, it is shown that, in the Examples 1 to 13 of the present invention, a high-density thin-film image can be formed due to a satisfactory electrostatic transfer to the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107350, filed May 27, 2015, Japanese Patent Application No. 2016-043102, filed Mar. 7, 2016, which are hereby incorporated by reference herein in their entirety.

What is claimed is:

1. A curable liquid developer comprising;

a curable insulating liquid;

a toner particle that contains a pigment and a resin; and a cationic photoinitiator, wherein the viscosity of the curable insulating liquid at 25° C. is 1 to 100 mPa·s, A-B is not more than 1,000 mPa·s where A (mPa·s) is the viscosity of the curable liquid developer at 25° C. when the toner particle concentration in the curable liquid developer is 50 mass %, and B (mPa·s) is the viscosity of the curable liquid developer at 25° C. when the toner particle concentration in the curable liquid developer is 1 mass %, the toner particle has a volume-average particle diameter of 0.1 to 2.5 μm, and an average circularity of at least 0.946, and the cationic photoinitiator is represented by formula (1)

(1)

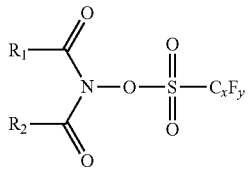

where $R_1$ and $R_2$ are bonded to each other to form a ring structure selected from the group consisting of a succinimide structure, a phthalimide structure, a norbornenedicarboximide structure, a naphthalenedicarboximide structure, a cyclohexanedicarboximide structure, and an epoxycyclohexenedicarboximide structure, each of which may be optionally substituted; x represents an integer from 1 to 8; and y represents an integer from 3 to 17.

2. The curable liquid developer according to claim 1, wherein the curable insulating liquid is an ultraviolet-curable insulating liquid.

3. The curable liquid developer according to claim 2, wherein the ultraviolet-curable insulating liquid comprises a cationically polymerizable vinyl ether compound.

4. The curable liquid developer according to claim 1, wherein the average circularity of the toner particle is at least 0.948.

5. The curable liquid developer according to claim 1, wherein the average circularity of the toner particle is at least 0.970.

6. The curable liquid developer according to claim 1, wherein the volume-average particle diameter of the toner particle is 0.1 to 1.2 μm.

7. An image-forming method comprising:

forming an electrostatic latent image on a surface of an image bearing member;

developing with a curable liquid developer the electrostatic latent image that has been formed on the surface of the image bearing member, and forming an image;

transferring onto a recording medium the image that has been formed on the surface of the image bearing member; and fixing the image to the recording medium after curing the image that has been transferred to the recording medium, the curable liquid developer comprising a curable insulating liquid, a cationic photoinitiator, and a toner particle that contains a pigment and a resin, wherein the viscosity of the curable insulating liquid at 25° C. is 1 to 100 mPa·s, A-B is not more than 1,000 mPa·s where A (mPa·s) is the viscosity of the curable liquid developer at 25° C. when the toner particle concentration in the curable liquid developer is 50 mass %, and B (mPa·s) is the viscosity of the curable liquid developer at 25° C. when the toner particle concentration in the curable liquid developer is 1 mass %, the toner particle has a volume-average particle diameter of 0.1 to 2.5 μm, and an average circularity of at least 0.946, the cationic photoinitiator is represented by formula (1)

(1)

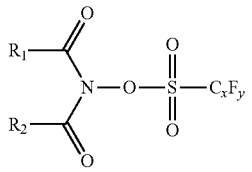

where $R_1$ and $R_2$ are bonded to each other to form a ring structure selected from the group consisting of a succinimide structure, a phthalimide structure, a norbornenedicarboximide structure, a naphthalenedicarboximide structure, a cyclohexanedicarboximide structure, and an epoxycyclohexenedicarboximide structure, each of which may be optionally substituted; x represents an integer from 1 to 8; and y represents an integer from 3 to 17, and the toner particle concentration in the image that has been transferred to the recording medium is 40 to 80 mass %.

8. The curable liquid developer according to claim 1, wherein the resin is a polyester resin.

* * * * *